US012442120B2

(12) United States Patent
Flores Islas et al.

(10) Patent No.: US 12,442,120 B2
(45) Date of Patent: Oct. 14, 2025

(54) LAUNDRY TREATMENT APPLIANCE AND METHOD OF DETERMINING LAUNDRY LOAD WEIGHT WITHIN THE SAME

(71) Applicant: Haier US Appliance Solutions, Inc., Wilmington, DE (US)

(72) Inventors: Erick Flores Islas, Louisville, KY (US); Jose Efren Rodriguez Munoz, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 146 days.

(21) Appl. No.: 18/532,478

(22) Filed: Dec. 7, 2023

(65) Prior Publication Data

US 2025/0188661 A1 Jun. 12, 2025

(51) Int. Cl.

| | |
|---|---|
| ***D06F 33/34*** | (2020.01) |
| ***D06F 33/36*** | (2020.01) |
| ***D06F 37/04*** | (2006.01) |
| *D06F 103/04* | (2020.01) |
| *D06F 105/02* | (2020.01) |

(52) U.S. Cl.

CPC ..... *D06F 33/34* (2020.02); *D06F 33/36* (2020.02); *D06F 37/04* (2013.01); *D06F 2103/04* (2020.02); *D06F 2105/02* (2020.02)

(58) Field of Classification Search

CPC ..... D06F 33/34

See application file for complete search history.

(56) References Cited

U.S. PATENT DOCUMENTS

| | | | |
|---|---|---|---|
| 5,161,393 | A | 11/1992 | Payne et al. |
| 6,481,246 | B1 | 11/2002 | Johnson et al. |
| 7,739,764 | B2 | 6/2010 | Zhang et al. |
| 10,400,378 | B2 | 9/2019 | Driussi |
| 11,572,648 | B2 | 2/2023 | Balinski et al. |

FOREIGN PATENT DOCUMENTS

| | | | |
|---|---|---|---|
| EP | 1913192 | B1 | 6/2016 |
| KR | 20080089840 | A | 10/2008 |

*Primary Examiner* — Jason Y Ko

(74) *Attorney, Agent, or Firm* — Dority & Manning, P.A.

(57) ABSTRACT

A laundry treatment appliance includes a cabinet; a tub positioned within the cabinet; a drum rotatably provided within the tub; a drain pump in fluid communication with the tub, the drain pump being positioned at a bottom of the cabinet; a pressure chamber attached to and in fluid communication with the drain pump; a pressure sensor operably connected with the pressure chamber; and a controller operably connected with the pressure sensor, the controller configured to perform an operation. The operation includes receiving a laundry load within the drum; supplying a baseline volume of water to the laundry load within the drum to create a saturated laundry load; determining an actual pressure related to the saturated laundry load within the drum; and determining a load size of the laundry load based on the determined actual pressure related to the saturated laundry load.

18 Claims, 5 Drawing Sheets

LAUNDRY TREATMENT APPLIANCE AND METHOD OF DETERMINING LAUNDRY LOAD WEIGHT WITHIN THE SAME

FIELD OF THE INVENTION

The present subject matter relates generally to laundry treatment appliances, and more particularly to laundry load size determination within laundry treatment appliances.

BACKGROUND OF THE INVENTION

Laundry treatment appliances (e.g., washing machine appliances) generally include a tub for containing water or wash fluid, e.g., water and detergent, bleach, and/or other wash additives. A basket or drum is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

It is frequently desirable to determine the size (e.g., weight) of a load of clothes or laundry within the washing machine appliance, e.g., in order to optimize water usage, agitation time, agitation profile selection, and other wash parameters. In addition, the spin speed of the basket may frequently need to be limited based on load weight, e.g., due to the allowed system stresses and operating dynamics. However, conventional load weight detection requires complicated and costly sensors and such systems frequently suffer from inaccurate measurements, resulting in relatively poor wash performance.

Accordingly, a washing machine appliance with features for improved load weight detection would be desirable. More specifically, a system and method for monitoring load weight without complex sensors or algorithms would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet; a tub positioned within the cabinet; a drum rotatably provided within the tub; a drain pump in fluid communication with the tub, the drain pump being positioned at a bottom of the cabinet; a pressure chamber attached to and in fluid communication with the drain pump; a pressure sensor operably connected with the pressure chamber; and a controller operably connected with the pressure sensor, the controller configured to perform an operation. The operation may include receiving a laundry load within the drum; supplying a baseline volume of water to the laundry load within the drum to create a saturated laundry load; determining an actual pressure related to the saturated laundry load within the drum; and determining a load size of the laundry load based on the determined actual pressure related to the saturated laundry load.

In another exemplary aspect of the present disclosure, a method of operating a laundry treatment appliance is provided. The laundry treatment appliance may include a tub, a drum provided within the tub, a drain pump in fluid communication with the tub, a pressure chamber attached to and in fluid communication with the drain pump, and a pressure sensor operably connected with the pressure chamber. The method may include receiving a laundry load within the drum; supplying a baseline volume of water to the laundry load within the drum to create a saturated laundry load; determining an actual pressure related to the saturated laundry load within the drum; and determining a load size of the laundry load based on the determined actual pressure related to the saturated laundry load.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
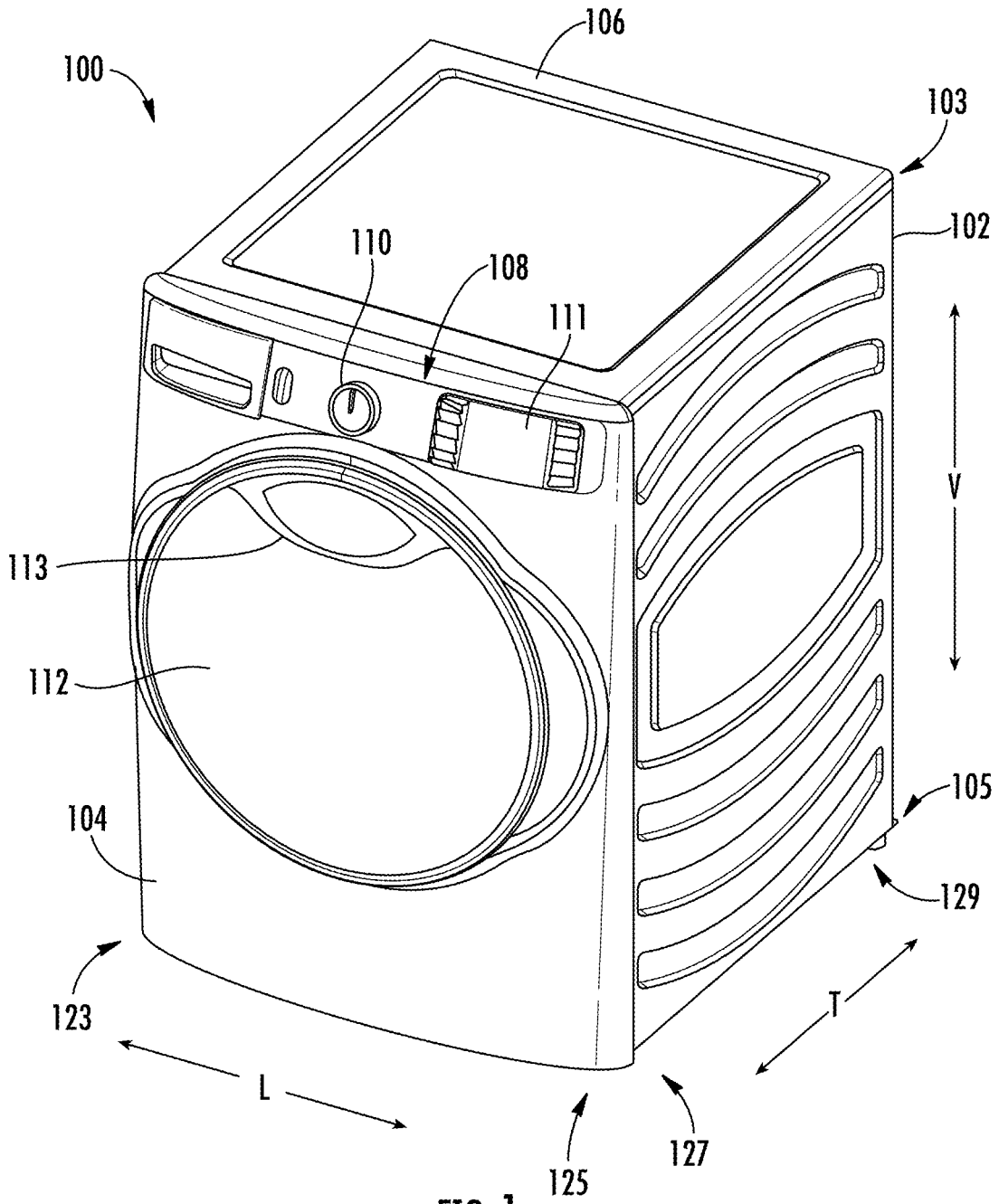
FIG. 1 provides a front, perspective view of a laundry treatment appliance according to an exemplary embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
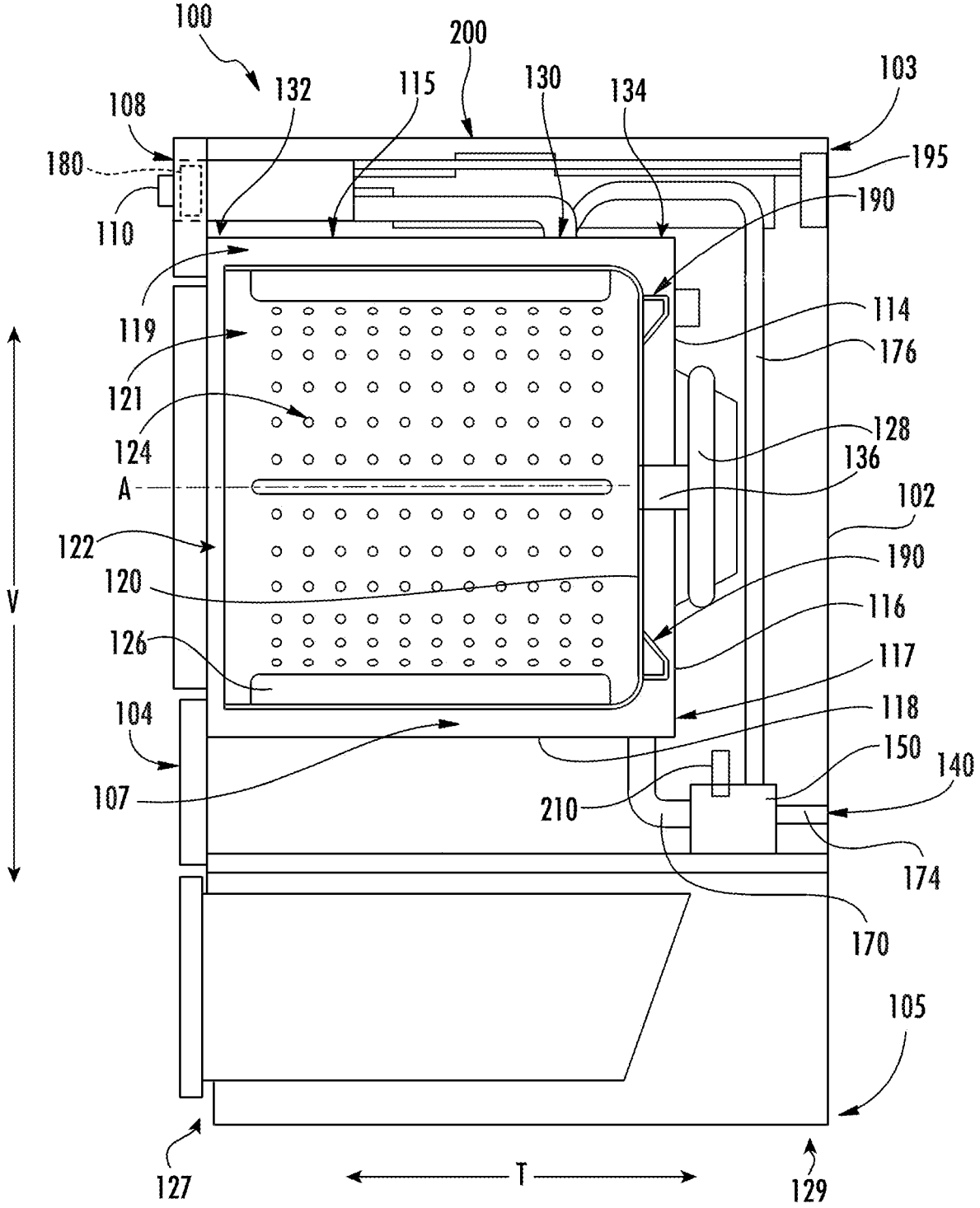
FIG. 2 provides a side, cross-sectional view of the exemplary laundry treatment appliance of FIG. 1.

FIGS. 1 and 2 provide various views of an exemplary laundry treatment apparatus 100 according to one exemplary embodiment of the present disclosure. In particular, FIG. 1 provides a front, perspective view of horizontal axis laundry treatment apparatus 100 and FIG. 2 provides a side, section view of laundry treatment apparatus 100. As shown in FIG. 1, laundry treatment apparatus 100 includes a cabinet 102 that extends between a top 103 and a bottom 105, e.g., along a vertical direction V. Cabinet 102 also extends between a first side 123 and a second side 125, e.g., along a lateral direction L, and between a front 127 and a rear 129, e.g., along a transverse direction T. The vertical, lateral, and transverse directions V, L, T defined by laundry treatment apparatus 100 are mutually perpendicular and together define an orthogonal direction system. Cabinet 102 may form a receiving space.

Cabinet 102 may include a front panel 104. A door 112 may be mounted to front panel 104 and may be rotatable between an open position (not shown) facilitating access to a wash drum or basket 120 (FIG. 2) located within cabinet 102, and a closed position (shown in FIGS. 1 and 2) hindering access to basket 120. A user may pull on a handle 113 in order to selectively adjust door 112 between the open and closed positions. Cabinet 102 may also include a top panel 106 positioned at top 103 of cabinet 102.

A control panel 108 including a plurality of input selectors 110 may be coupled to front panel 104. Control panel 108 and input selectors 110 may collectively form a user interface input for operator selection of machine cycles and features. For example, in some embodiments, control panel 108 includes a display 111 (FIG. 1) configured to present or indicate selected features, a countdown timer, and/or other items of interest to machine users.

As shown in FIG. 2, a tub 114 may be positioned within cabinet 102 and may define a wash fluid compartment 119 configured for receipt of a washing fluid. Thus, tub 114 may be configured for containing washing fluid, e.g., during operation of laundry treatment apparatus 100. Washing fluid disposed within tub 114 may include, for example, at least one of water, fabric softener, bleach, and detergent. Tub 114 may include a back wall 116 and a sidewall 118 and may extend between a top 115 and a bottom 117, e.g., along the vertical direction V. Further, tub 114 may extend between a front 132 and a rear 134, e.g., along the transverse direction T.

Basket 120 may be rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 may define a wash chamber 121 and an opening 122. Opening 122 of basket 120 permits access to wash chamber 121 of basket 120, e.g., in order to load articles into basket 120 and remove articles from basket 120. Basket 120 may also define a plurality of perforations 124 to facilitate fluid communication between an interior of basket 120 and tub 114. A sump 107 may be defined by tub 114 and may be configured for receipt of washing fluid during operation of appliance 100. For example, during operation of appliance 100, washing fluid may be urged by gravity from basket 120 to sump 107 through the plurality of perforations 124.

A spout 130 may be configured for directing a flow of fluid into tub 114. Spout 130 may be in fluid communication with a water supply (not shown) in order to direct fluid (e.g., clean water) into tub 114. A pump assembly 150 (shown schematically in FIG. 2) may be located beneath tub 114 for draining tub 114 of fluid. Pump assembly 150 may be in fluid communication with sump 107 of tub 114 via a conduit 170. Thus, conduit 170 may direct fluid from tub 114 to pump assembly 150. Pump assembly 150 may also in fluid communication with a drain 140 via piping 174. Pump assembly 150 can urge fluid disposed in sump 107 to drain 140 during operation of appliance 100 in order to remove fluid from tub 114. Fluid received by drain 140 from pump assembly 150 may be directed out of appliance 100, e.g., to a sewer or septic system.

In some instances, pump assembly 150 may also be configured for recirculating washing fluid within tub 114. Thus, pump assembly 150 may be configured for urging fluid from sump 107, e.g., to spout 130. For example, pump assembly 150 may urge washing fluid in sump 107 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 may be provided in mechanical communication with basket 120 in order to selectively rotate basket 120, e.g., during an agitation or a rinse cycle of laundry treatment apparatus 100 as described below. In particular, a shaft 136 may mechanically couple motor 128 with basket 120 and drivingly rotate basket 120 about a shaft or central axis A, e.g., during a spin cycle. Ribs 126 may extend from basket 120 into wash chamber 121. Ribs 126 may assist agitation of articles disposed within wash chamber 121 during operation of laundry treatment apparatus 100. For example, ribs 126 may lift articles disposed in basket 120 during rotation of basket 120.

Also shown in FIG. 2 is a balancing apparatus 190. Balancing apparatus 190 may include a balancing ring, for example. The balancing ring can have an annular cavity in which a balancing material is free to rotate and move about. For example, the balancing material can be a fluid such as water or can be balancing balls. The balancing ring may include one or more interior baffles. Although a single balancing ring or apparatus 190 is shown in FIG. 2, any number of such rings or apparatuses may be included in laundry treatment apparatus 100 and may be placed according to any known or desirable configuration. For example, two balancing rings may be respectively placed at the front and back of basket 120.

As further shown in FIG. 2, laundry treatment apparatus 100 includes a detergent dispenser 200. Detergent dispenser 200 may include features for receiving various wash treatment additives (e.g., fluid detergent, powder detergent, fabric softener, bleach, powder or any other suitable liquid) and dispensing or directing them to wash fluid compartment 119 of tub 114 during operation of laundry treatment apparatus 100.

Operation of laundry treatment apparatus 100 may be controlled by a processing device or controller 180 that is operatively coupled to control panel 108 for user manipulation to select washing cycles and features. In response to user manipulation of control panel 108, controller 180 may operate the various components of laundry treatment apparatus 100 to execute selected machine cycles and features.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, gates, and the like) to perform control functionality instead of relying upon software. Control panel 108 and other components of laundry treatment apparatus 100 may be in communication with controller 180 via one or more signal lines or shared communication busses.

In an illustrative example of operation of laundry treatment apparatus 100, laundry items are loaded into basket 120, and a washing operation is initiated through operator manipulation of input selectors 110. Tub 114 may be filled with water and one or more wash treatment additives from detergent dispenser 200 to form a wash fluid. One or more valves of a water inlet valve 195 can be actuated by controller 180 to provide for filling tub 114 to the appropriate level for the amount (or number) of articles being washed. Water inlet valve 195 is in fluid communication with a water source, such as e.g., a hot water heater and/or a municipal water line. Once tub 114 is properly filled with wash fluid, the contents of basket 120 may be agitated with ribs 126 for cleansing of laundry items in basket 120.

After the agitation phase (e.g., first agitation phase, second agitation phase, etc.) of the wash cycle is completed, tub 114 may be drained. Laundry articles may then be rinsed by again adding wash fluid (or water) to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During the spin cycle, basket 120 is rotated at relatively high speeds.

While described in the context of a specific embodiment of horizontal axis laundry treatment apparatus 100, it will be understood that horizontal axis laundry treatment apparatus 100 is provided by way of example only. Other laundry treatment apparatuses having different configurations, different appearances, and/or different features may also be utilized with the present subject matter as well, including, for example, vertical axis laundry treatment apparatuses. Thus, the teachings of the present disclosure are not limited to use with laundry treatment apparatus 100.

Referring to FIGS. 2 through 5, laundry treatment appliance may include a pressure chamber 210. Pressure chamber 210 may be provided for facilitating tub pressure measurements. For example, a hose 212 may connect the pressure chamber 210 to a pressure sensor 214. Pressure sensor 214 may measure, detect, or otherwise determine a pressure in pressure chamber 210 or at another suitable location within tub 114, and may be in operative communication with controller 180. Pressure sensor 214 may be a component of the controller 180 or may be a separate component from controller 180 which is in communication with controller 180 through a suitable wired or wireless connection. Pressure sensor 214 may, for example, be an analog pressure sensor, a digital pressure sensor, a mechanical pressure switch, or any other suitable device capable of measuring pressure as required herein.

Pressure chamber 210 may be provided at pump assembly 150. For instance, pressure chamber 210 may be in fluid communication with liquid (e.g., water, wash fluid, etc.) flowing through pump assembly 150. Pressure chamber 210 may include an inner opening 220 and an outer opening 222 and may extend between these openings to place an interior of pump assembly 150 and hose 212 in fluid communication. A water column may form within pressure chamber 210. Moreover, a gas (e.g., air) may be present within hose 212. Accordingly, the pressure within the system (e.g., within basket 120 or tub 114) may be determined according to a level of the water column within pressure chamber 210. However, the determination of the pressure within the system may be determined by any suitable means, and the descriptions given herein are provided by way of example only.

Figure 3:
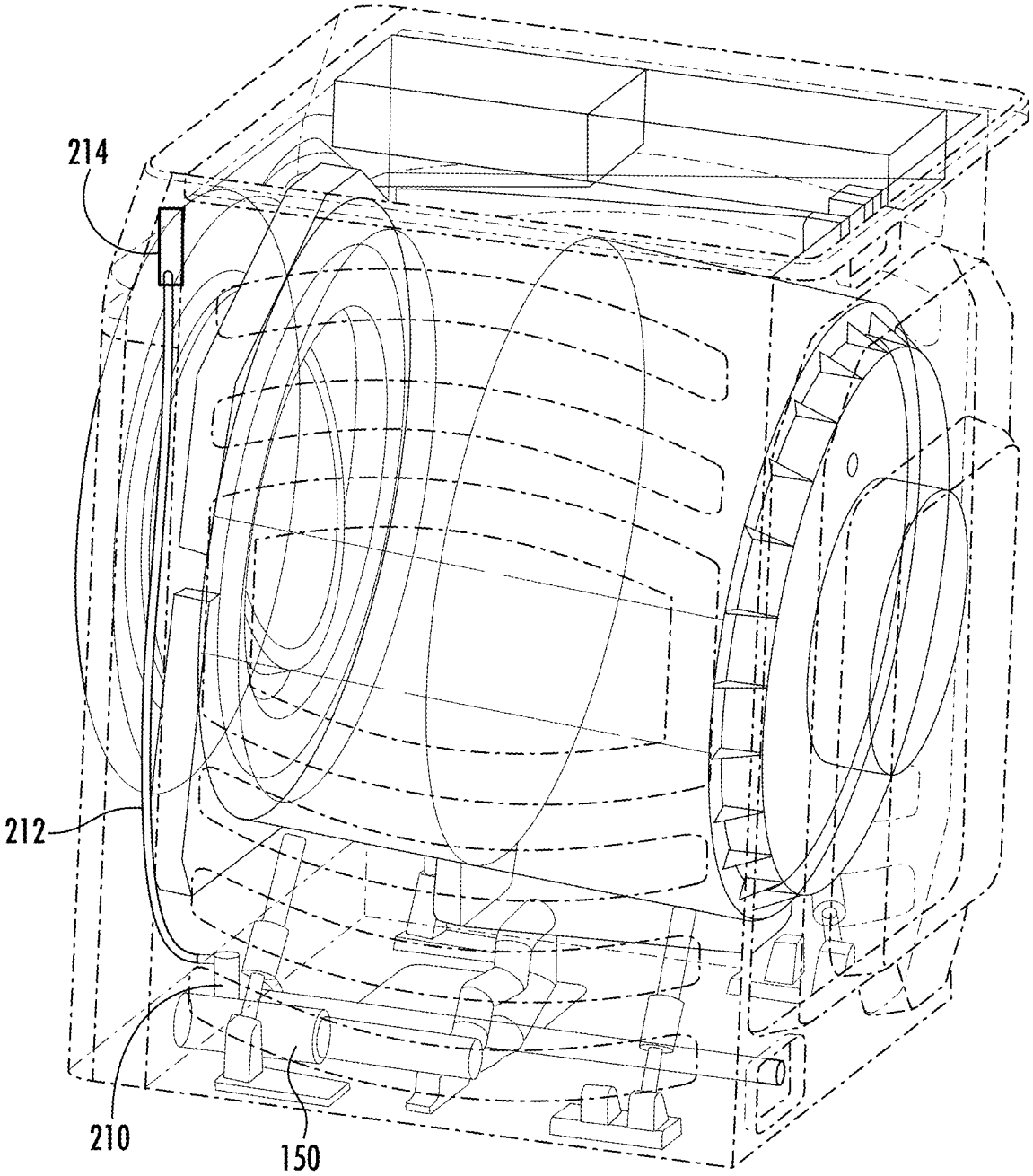
FIG. 3 provides a perspective view of interior features of the exemplary laundry treatment appliance of FIG. 1.
Figure 4:
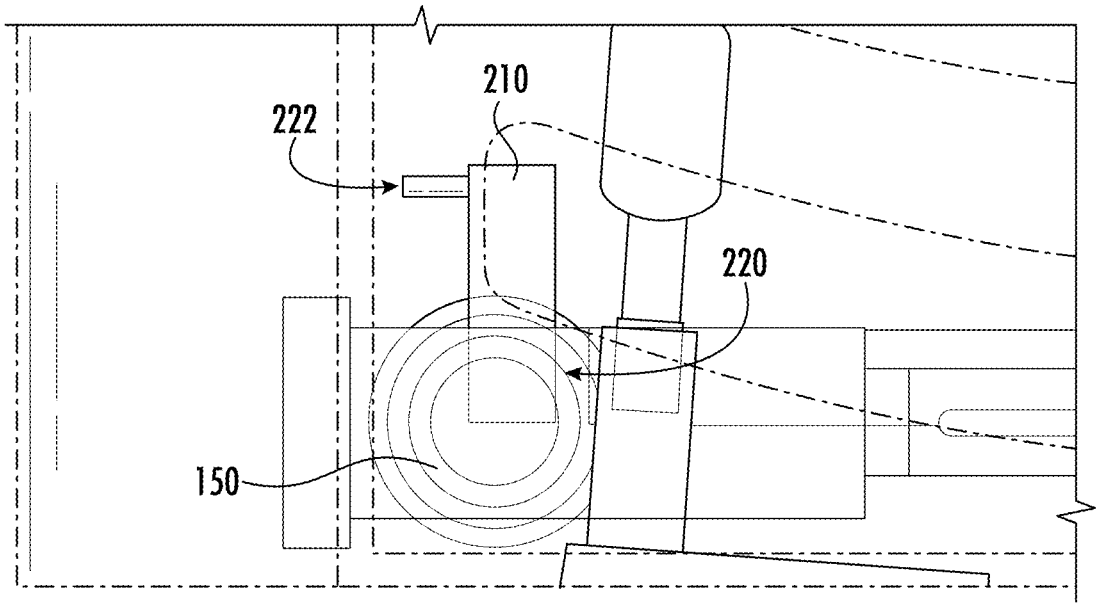
FIG. 4 provides a close-up side view of a drain assembly including a pressure chamber of the exemplary laundry treatment appliance of FIG. 1.
Figure 5:
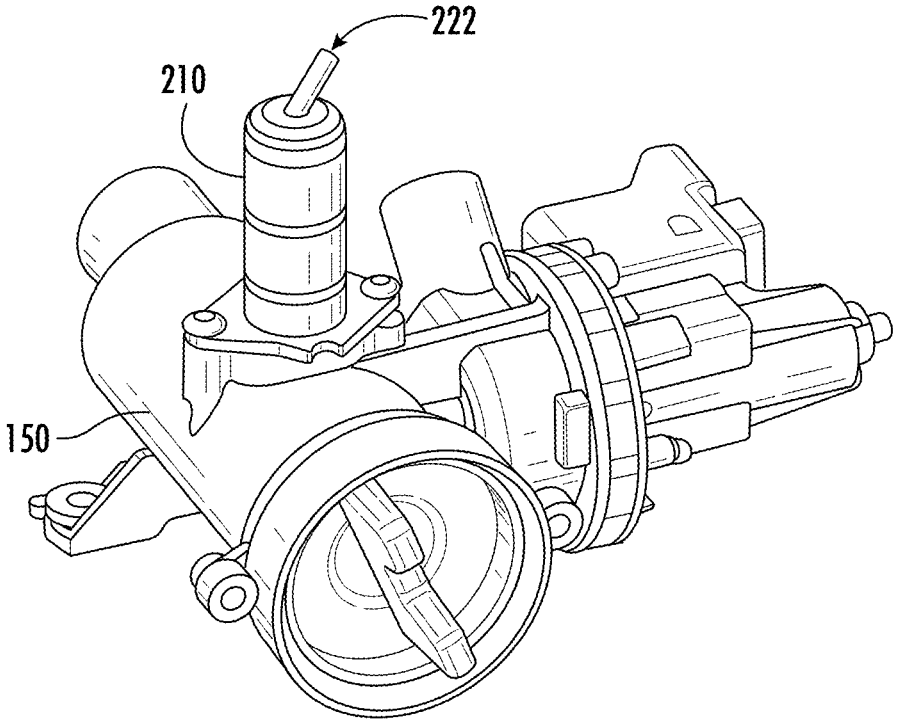
FIG. 5 provides a perspective view of the drain assembly of FIG. 4.

As shown particularly in FIGS. 3 and 4, pressure chamber 210 may be provided at or near a bottom of laundry treatment appliance 100 (e.g., within cabinet 120). Accordingly, the water column formed within pressure chamber 210 may be based on a stationary reference point. The stationary reference point may be, for instance, pump assembly 150, a bottom panel of cabinet 102, a floor on which appliance 100 is installed, or the like. Advantageously, extraneous variables such as changes in height of pressure chamber 210 are avoided, leading to more accurate and repeatable measurements of pressure within the system.

Figure 6:
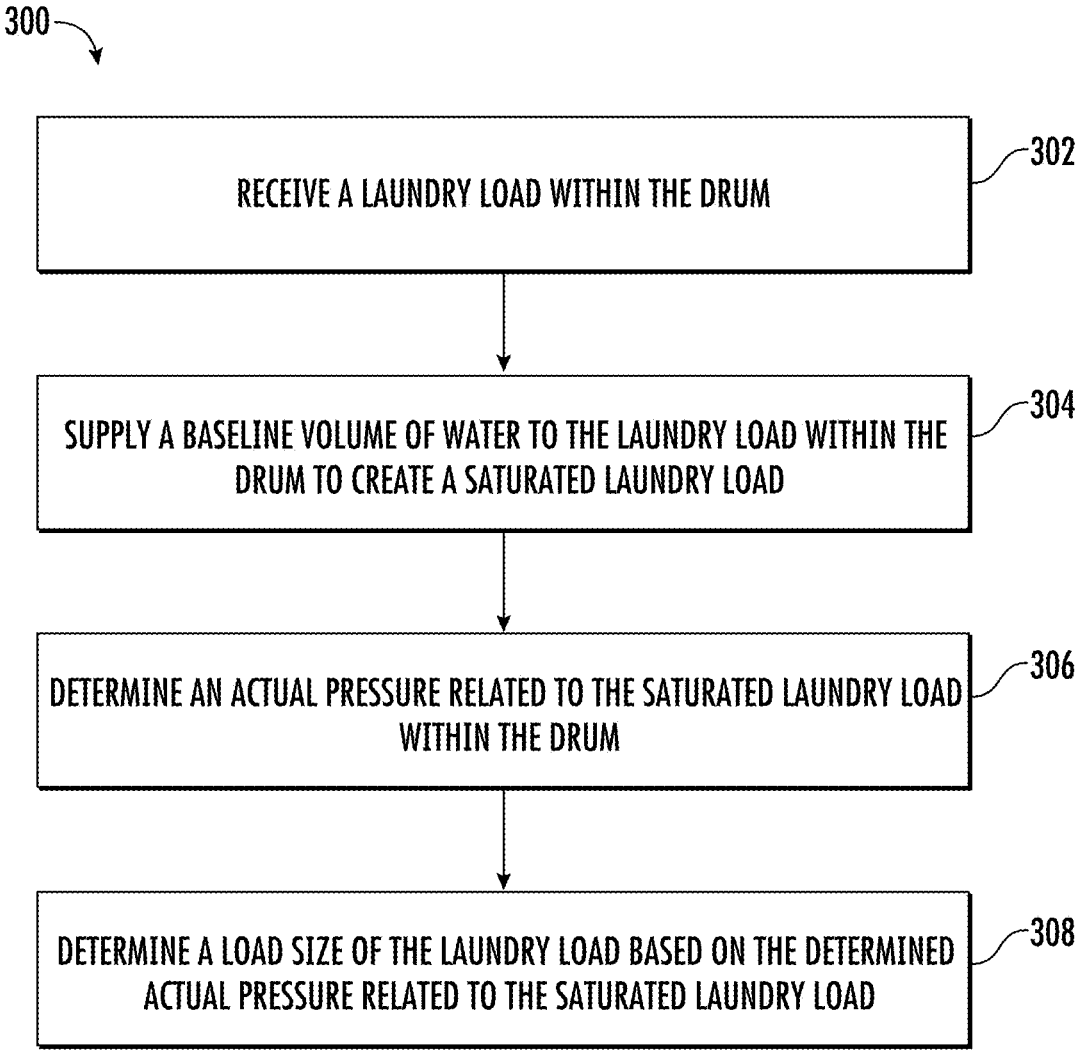
FIG. 6 provides a flow chart illustrating a method of operating a laundry treatment appliance according to exemplary embodiments of the present disclosure.

Now that the general descriptions of an exemplary appliance has been described in detail, a method 300 of operating an appliance (e.g., laundry treatment appliance 100) will be described in detail. Although the discussion below refers to the exemplary method 300 of operating laundry treatment appliance 100, one skilled in the art will appreciate that the exemplary method 300 is applicable to any suitable domestic appliance capable of performing a washing operation (e.g., such as a combination washing machine/dryer, a stand-alone washer, etc.). In exemplary embodiments, the various method steps as disclosed herein may be performed by controller 180 and/or a separate, dedicated controller. FIG. 6 provides a flow chart illustrating a method of operating a laundry treatment appliance. Hereinafter, method 300 will be described with specific reference to FIG. 6.

At step 302, method 300 may include receiving a laundry load within the drum (e.g., basket 120). For instance, a user may position a laundry load (e.g., clothing, towels, bedding, etc.) within the drum of the appliance to initiate a washing operation. The appliance may determine that the laundry load has been received within the drum. For instance, the user may activate the appliance by manipulating one or more controls (e.g., on user interface 108). Additionally or alternatively, one or more sensors may sense the addition of the laundry load or an initiation of the washing cycle, For instance, the appliance may detect an opening of the door (e.g., door 112).

At step 304, method 300 may include supplying a baseline volume of water to the laundry load within the drum. The baseline volume of water together with the laundry load may form or create a saturated laundry load. For instance, the baseline volume of water may be sufficient to dampen the laundry load (e.g., to a predetermined dampness level). The baseline volume of water may be any suitable predetermined volume of water.

The baseline volume of water may be determined prior to receiving the laundry load within the drum. For instance, the baseline volume of water may be determined during a construction, assembly, or testing phase of the appliance (e.g., during manufacturing). The baseline volume of water may be determined during a calibration operation. The calibration operation may be performed before an initial commercial (or home) use of the laundry appliance.

The calibration operation may include supplying the baseline volume of water to the drum (or tub) and measuring a baseline pressure. For instance, the baseline volume of water may be added to an empty drum (e.g., no laundry load or articles within). The baseline pressure may then be measured (e.g., at the pressure sensor via the pressure chamber). The baseline pressure may then be stored within an on board memory of the appliance. Additionally or alternatively, the baseline pressure may be stored on a remote device (e.g., smartphone app). As mentioned above, the baseline pressure may be determined according to a water column formed within the pressure chamber upon the addition of the baseline volume of water to the tub.

At step 306, method 300 may include determining an actual pressure related to the saturated laundry load within the drum. In detail, after each of the laundry load and the baseline volume of water have been added to the system (e.g., the drum and the tub), a pressure measurement may be taken. The pressure sensor may determine the pressure within the system accounting for both of the baseline volume of water and the laundry load. As mentioned above, the actual pressure may be determined according to the water column formed within the pressure chamber. Thus, the water column within the pressure chamber may be indicative of the actual pressure within the pressure chamber, and therefore the actual pressure within the system.

At step 308, method 300 may include determining a load size of the laundry load based on the determined actual pressure related to the saturated laundry load. For instance, method 300 may infer, calculate, or otherwise extrapolate a size of the laundry load based on the actual pressure within the system. The actual pressure determined at step 306 may be compared against the baseline pressure of the system (e.g., as stored on board the appliance). For one example, a height of the water column within the pressure chamber at the baseline pressure is compared against a height of the water column within the pressure chamber at the actual pressure. The difference thereof may be used to determine the size of the laundry load.

The size of the laundry load may be determined as a weight of the laundry load. For instance, upon determining the difference in the height of the water columns, method 300 may, via one or more equations, algorithms, computations, or calculations, determine the weight of the laundry load. For one example, the water column (e.g., actual pressure) decreases as the system (e.g., the tub) is lowered by the weight of the laundry load. Through one or more means (e.g., interpolation, calculation, etc.), method 300 may estimate the weight of the laundry load.

Method 300 may further include developing a wash cycle based on a plurality of wash parameters. In detail, the plurality of wash parameters may be determined according to the size (e.g., weight) of the laundry load. The plurality of wash parameters may include a total amount of water (e.g., for a base fill), an agitation intensity, a spin speed, a spin duration, a rinse volume, a detergent amount (e.g., volume), or the like. The plurality of wash parameters may be calculated according to the determined size of the laundry load. Additionally or alternatively, the plurality of wash parameters may be retrieved from a table. For instance, the table of appropriate parameters for the wash cycle may be preprogrammed and stored on board the appliance. A particular set of parameters may be stored for certain weight differences (e.g., every 5 pounds, every 7 pounds, every 10 pounds, etc.). Thus, when the actual size (e.g., weight) of the laundry load is determined, the appropriate wash parameters may be retrieved from the table. Moreover, determined weights between prestored weights may be interpolated to find appropriate wash parameters.

Method 300 may further include initiating the wash cycle according to the plurality of wash parameters. For instance, upon retrieving, calculating, or otherwise determining the plurality of wash parameters, method 300 may proceed to initiate the wash cycle. Additionally or alternatively, method 300 may present a prompt to the user to manually initiate the wash cycle. For example, method 300 may display a prompt on the user interface for the user to start the wash cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance defining a vertical direction, a lateral direction, and a transverse direction, the laundry treatment appliance comprising:
a cabinet;
a tub positioned within the cabinet;
a drum rotatably provided within the tub;
a drain pump in fluid communication with the tub, the drain pump being positioned at a bottom of the cabinet;
a pressure chamber attached to and in fluid communication with the drain pump;
a pressure sensor operably connected with the pressure chamber; and
a controller operably connected with the pressure sensor, the controller configured to perform an operation, the operation comprising:
receiving a laundry load within the drum;
supplying a baseline volume of water to the laundry load within the drum to create a saturated laundry load;
determining an actual pressure related to the saturated laundry load within the drum; and
determining a load size of the laundry load based on the determined actual pressure related to the saturated laundry load.

2. The laundry treatment appliance of claim 1, wherein the baseline volume of water is determined during a calibration operation, the calibration operation being performed prior to receiving the laundry load within the drum.

3. The laundry treatment appliance of claim 1, wherein determining the actual pressure related to the saturated laundry load comprises:
sensing, at the pressure sensor, a pressure within the pressure chamber, wherein the pressure within the pressure chamber is based on a water column within the pressure chamber.

4. The laundry treatment appliance of claim 1, wherein determining the load size of the laundry load comprises:
comparing the actual pressure relating to the saturated laundry load against a baseline pressure.

5. The laundry treatment appliance of claim 4, wherein the baseline pressure is determined according to the baseline volume of water within the tub without the laundry load.

6. The laundry treatment appliance of claim 5, wherein the baseline pressure is stored within a memory of the laundry treatment appliance.

7. The laundry treatment appliance of claim 4, wherein determining the load size of the laundry load further comprises:
calculating a weight of the laundry load based on a difference between the actual pressure relating to the saturated laundry load and the baseline pressure.

8. The laundry treatment appliance of claim 1, wherein the operation further comprises:
developing a wash cycle based on a plurality of wash parameters determined from the load size of the laundry load; and
initiating the wash cycle according to the plurality of wash parameters.

9. The laundry treatment appliance of claim 1, wherein the laundry treatment appliance is a front-load washing machine.

10. A method of operating a laundry treatment appliance, the laundry treatment appliance comprising a tub, a drum provided within the tub, a drain pump in fluid communication with the tub, a pressure chamber attached to and in fluid communication with the drain pump, and a pressure sensor operably connected with the pressure chamber, the method comprising:
receiving a laundry load within the drum;
supplying a baseline volume of water to the laundry load within the drum to create a saturated laundry load;
determining an actual pressure related to the saturated laundry load within the drum; and
determining a load size of the laundry load based on the determined actual pressure related to the saturated laundry load.

11. The method of claim 10, wherein the baseline volume of water is determined during a calibration operation, the calibration operation being performed prior to receiving the laundry load within the drum.

12. The method of claim 10, wherein determining the actual pressure related to the saturated laundry load comprises:
sensing, at the pressure sensor, a pressure within the pressure chamber, wherein the pressure within the pressure chamber is based on a water column within the pressure chamber.

13. The method of claim 10, wherein determining the load size of the laundry load comprises:
comparing the actual pressure relating to the saturated laundry load against a baseline pressure.

14. The method of claim 13, wherein the baseline pressure is determined according to the baseline volume of water within the tub without the laundry load.

15. The method of claim 14, wherein the baseline pressure is stored within a memory of the laundry treatment appliance.

16. The method of claim 13, wherein determining the load size of the laundry load further comprises:
calculating a weight of the laundry load based on a difference between the actual pressure relating to the saturated laundry load and the baseline pressure.

17. The method of claim 10, further comprising:
developing a wash cycle based on a plurality of wash parameters determined from the load size of the laundry load; and
initiating the wash cycle according to the plurality of wash parameters.

18. The method of claim 10, wherein the laundry treatment appliance is a front-load washing machine.

* * * * *